United States Patent [19]

Rogge

[11] Patent Number: 4,563,949

[45] Date of Patent: Jan. 14, 1986

[54] PRINTING PRESS

[75] Inventor: Dieter Rogge, Lengerich, Fed. Rep. of Germany

[73] Assignee: Windmoller & Holscher, Lengerich, Fed. Rep. of Germany

[21] Appl. No.: 605,562

[22] Filed: Apr. 30, 1984

[30] Foreign Application Priority Data

May 2, 1983 [DE] Fed. Rep. of Germany ..... 3315891

[51] Int. Cl.[4] ..... B41F 5/24

[52] U.S. Cl. ..... 101/174; 101/216

[58] Field of Search ..... 101/173, 174, 175, 176, 101/177, 153, 181, 182, 253, 152, 247

[56] References Cited

U.S. PATENT DOCUMENTS

| | | | |
|---|---|---|---|
| 1,672,073 | 6/1928 | Molins | 101/181 X |
| 1,868,963 | 7/1932 | Barber | 101/181 X |
| 2,084,281 | 6/1937 | Meisel | 101/181 |
| 2,146,963 | 2/1939 | Lang | 101/153 |
| 2,470,243 | 5/1949 | Frostad | 101/181 X |
| 3,179,045 | 4/1965 | Evers | 101/181 |
| 3,416,444 | 12/1968 | Cahn | 101/181 |
| 3,604,350 | 9/1971 | Rosenstadt | 101/181 |
| 4,413,560 | 11/1983 | Rogge | 101/247 |

FOREIGN PATENT DOCUMENTS

| | | | |
|---|---|---|---|
| 0913057 | 6/1954 | Fed. Rep. of Germany | 101/181 |
| 3150833 | 7/1983 | Fed. Rep. of Germany . | |

*Primary Examiner*—William Pieprz
*Assistant Examiner*—James R. McDaniel
*Attorney, Agent, or Firm*—Fleit, Jacobson, Cohn & Price

[57] ABSTRACT

In a printing press having a plurality of inking mechanisms and plate cylinders with backing cylinders driven by a common central gear, the plate cylinders, inking mechanisms and inking cylinders (if any) are mounted on carriages which can be moved towards and away from the central gear. The shafts of respective upper and lower backing cylinders are mounted at the ends of two-armed levers which intersect in pairs, are pivotably mounted on the central shaft of the central gear and are provided with means for pivoting same in opposite senses or directions.

5 Claims, 5 Drawing Figures

PRINTING PRESS

The invention relates to a printing press of a type disclosed in German Pat. No. 31 50 833, with a plurality of inking mechanisms and a plurality of plate cylinders and backing cylinders driven by a common central gear, wherein the plate cylinders, inking mechanism and any inking cylinders are mounted on carriages which can be applied to and removed from the associated backing cylinders along guides extending from approximately tangentially to radially of the central gear, the pitch circles of the gears of the backing cylinders being located relative to the central gear in such a way that they will, when projected axially, make contact with the pitch circle of the central gear, and wherein, at the contact point zones of the press, the gears of the plate cylinders engage the central gear as well as the gears of the backing cylinders.

If there are three plate cylinders with associated inking mechanisms on each side of the central gear of the printing press, only the central plate cylinders are displaceable for application and removal purposes along a common diametral line which also extends through the axes of the backing cylinders. When changing the size, the gears of the plate cylinders displaceable on a common diametral line can also be brought into engagement with the gears of the backing cylinder by simply applying them thereto, without any corrections being necessary for the shafts of the backing cylinders. However, the conditions are different in the case of the upper and lower plate cylinders which confront each other in pairs, and their associated inking mechanisms, which are movable on guides for application and withdrawal and after a size change, the direction of movement failing to intersect the axis of the central gear. For these plate cylinders it is therefore necessary after a size change to correct the axes of the backing cylinder shafts in such a way that the axes of the interengaging gears of the plate cylinders and the associated backing cylinders will, after a size change, again lie on a common line extending through the axis of the central gear.

In the printing press according to the above mentioned German patent, the upper and lower backing cylinders which are opposed in pairs have their shafts mounted in annular sector-shaped supporting members which are circumferentially displaceable and fixable between jaws that can be clamped to the side frames, whereby to ensure that the axes of each pair of plate cylinder and backing cylinder will lie on a diametral line of the central gear in the printing position. According to the German patent, displacement of the shafts or axes of the backing cylinders takes place on the surface of the ideal enveloping cylinder of the central gear to enable the necessary corrections of the axes of the backing cylinders to be made after a size change and the replacement of plate cylinders necessitated thereby. The adjustment of the backing cylinder axes by means of the annular sector-shaped supporting members described in the German patent is not only cumbersome from the point of view of manipulation but also necessitates a considerable constructional expense because the individual segments serving for the adjustment have to be produced with a high accuracy and must be provided with separate adjusting means. In this connection, it must be borne in mind that the clamped annular sector-shaped supporting members have to carry the full weight of the backing cylinders which, apart from the necessary accuracy, also calls for an adequately robust construction.

It is therefore the problem of the invention to provide a printing press according to the German patent which, after a size change, facilitates simpler adjustment of the intersecting opposed axes of the respective upper and lower backing cylinders.

According to the invention, this problem is solved in a printing press according to the German patent in that the shafts of the respective upper and lower backing cylinders are mounted at the ends of two-armed levers which intersect in pairs, are pivotably mounted on the central shaft of the central gear and are provided with means for pivoting same in opposite senses. The printing press according to the invention permits precise adjustment of the axes of the backing cylinders after a size change because the respectively aligned arms of the intersecting two-armed levers are mounted on the central shaft and therefore precisely pivot the backing cylinder thereon on the enveloping cylinder concentric with the shaft of the central gear. Further, the arms carry the respectively opposed backing cylinders in a rocker-like manner, which permits a lighter construction.

Other advantageous embodiments of the invention have been described in the subsidiary claims.

The arrangement according to the invention can be embodied in a flexographic as well as an intaglio printing press.

One example of the invention will now be described in more detail with reference to the drawing, wherein.

Figure 3:
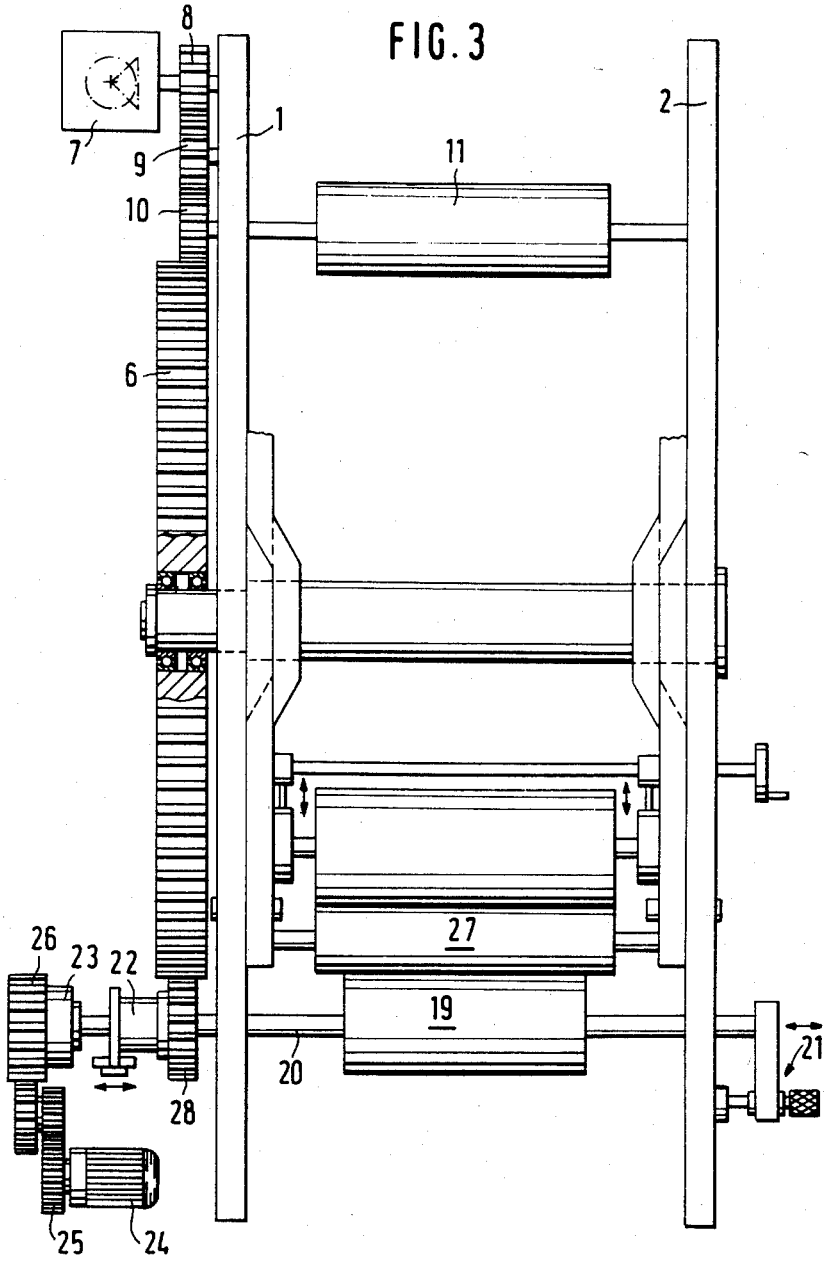
FIG. 3 is a section of the printing press on the line III—III in FIG. 1.

Side frames 1 and 2 are interconnected by cross-members 3 and a central shaft 4. The central shaft 4 projects out of the frame 1, a central gear 6 being freely rotatable on the projecting portion 5. This central gear 6 is driven by the gearing 7, the gear 8, the intermediate gear 9 and the drive gear 10 of the feed roller 11. Apart from the feed roller 11 there are two further feed rollers 12 and 13, the intermediate gear 9 likewise engaging the drive gear of the feed roller 13. All six plate cylinders 14 to 19 are driven from the central gear 6, FIG. 3 showing the drive for the plate cylinder 19. This plate cylinder 19 is mounted between the frames 1 and 2, as are the other plate cylinders, the plate cylinder shaft 20 projecting outwardly to a certain extent through the two frames 1 and 2.

The shaft portion projecting from the frame 2 is connected to a transverse registration adjustment 21 which is known per se and will here not be described in further detail. The part of the shaft 20 projecting out of the left-hand side of the frame 1 as viewed in FIG. 3 receives a known longitudinal registration adjustment 22 as well as a clutch 23 with a fixed point switch so that on the one hand the plate cylinder 19 can be adjusted circumferentially and on the other hand the plate cylinder 19 can be kept in rotation by way of a continued rotation motor 24 and by way of the gears 25 and 26 when the plate cylinder 19 is lifted off the pressure or backing cylinder 27, so that the ink will then not dry up. The longitudinal registration 22 and the function of the clutch 23 with fixed point switch will here not be described in more detail because they do not form part of the present invention and are part of the prior art.

Figure 1:
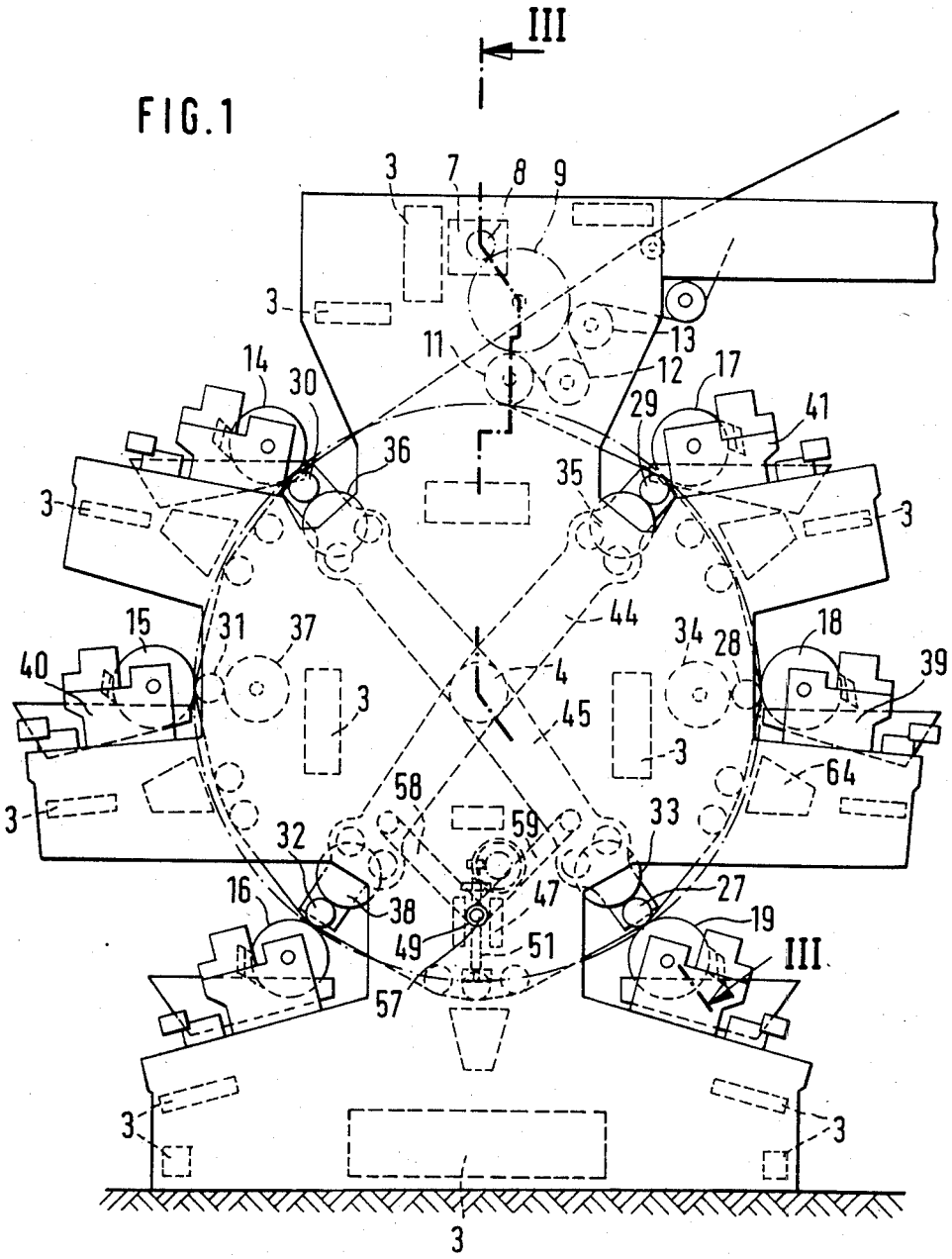
FIG. 1 is a diagrammatic front elevation of an intaglio printing press.

During printing, however, the plate cylinder 19 is driven by the drive gear 28 having a pitch circle diameter corresponding to the diameter of the plate cylinder 19. As is shown in FIG. 1, every impression or backing cylinder 27 to 32 is associated with a supporting cylinder 33 to 38. The two impression cylinders 28 and 31 as well as the supporting cylinders 34 and 37 are rotatably mounted in the two frames 1 and 2. Their position between the frames 1 and 2 need not be changed even upon replacement of the plate cylinders 18 and 15 because the plate cylinder blocks 39 and 40 are displaced substantially in one plane which extends through the central shaft 4 so that, after exchanging the plate cylinders 15 and 18 for other cylinders, mere displacement of the plate cylinder blocks 39 and 40 will ensure engagement of the drive gears of the new plate cylinders and the linear abutment of the new plate cylinders against the impression cylinders 28 and 31.

Figure 4:
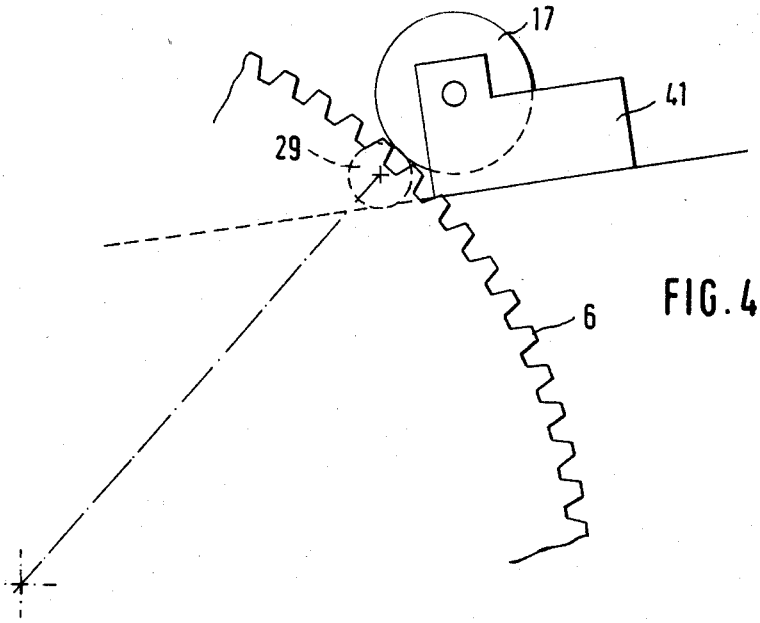
FIG. 4 is a diagrammatic representation of backing and plate cylinders arranged on a common diametral line and with their gears in mesh.
Figure 5:
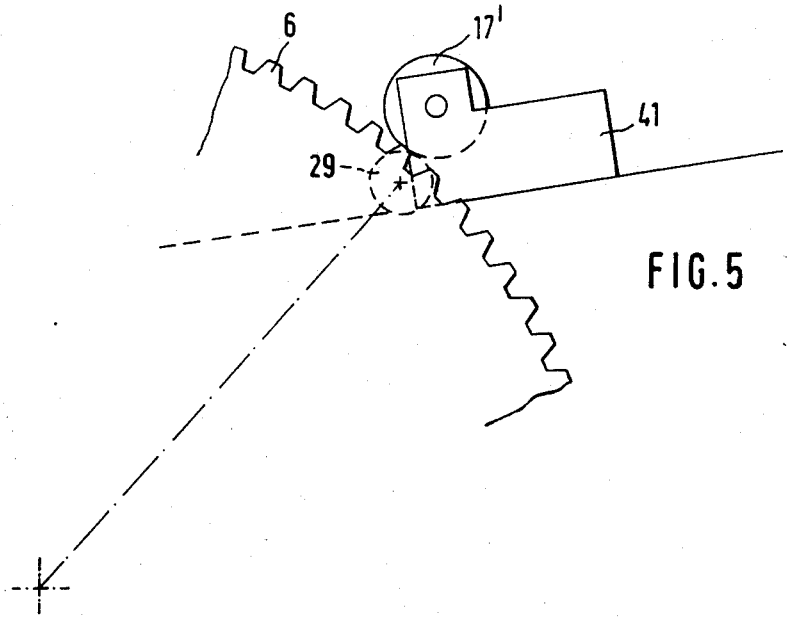
FIG. 5 is a view corresponding to FIG. 4 after correction of the axes of the backing cylinder necessitate by a change in size.

However, upon application to and withdrawal from the associated impression cylinders, the plate cylinders 14, 16, 17 and 19 are not moved on diametral lines of the central gear. Accordingly, it is necessary when changing the plate cylinders to move the impression cylinders on an enveloping cylinder concentric with the axis of the central gear, to ensure that the axes of each pair of plate and impression cylinders will lie on a diametral line of the central gear in the printing position. This need will become evident when viewing FIGS. 4 and 5. In FIG. 4, the plate cylinder 17 and associated impression cylinder 29 are shown in a simplified form as compared with FIG. 1. In FIG. 5, the plate cylinder 17 of FIG. 4 has been replaced by a smaller plate cylinder 17'. From FIG. 5 it will now be seen clearly that, by displacing the plate cylinder block 41, the drive gear of this plate cylinder 17' already engages the central gear 6 but the plate cylinder 17' itself does not yet touch the impression cylinder 29 (the pitch circle of the plate cylinder drive gear is equal to the circumference of the plate cylinder itself, for which reason only one circle is visible). Now, to bring the axis of the impression cylinder 29 and the axis of the plate cylinder 17' onto a diametral line of the central gear 6, it is necessary to pivot the impression cylinder 29 in the counter-clockwise direction. The impression cylinder 32 must also be pivoted counter-clockwise to the same extent as the impression cylinder 29. The impression cylinders 27 and 30 have to be pivoted clockwise correspondingly, namely to the same extent as the impression cylinders 29 and 32 have to be pivoted in the counter-clockwise direction. To achieve this in a simple manner, four levers 42 to 45 are freely rotatable on the central shaft 4, every two levers, namely the levers 42 and 43 or the levers 44 and 45, forming a pair which can be pivoted towards each other. In order that each pair of levers lies as closely as possible to the frame 1 or 2, the levers 42 and 44 are cranked.

Figure 2:
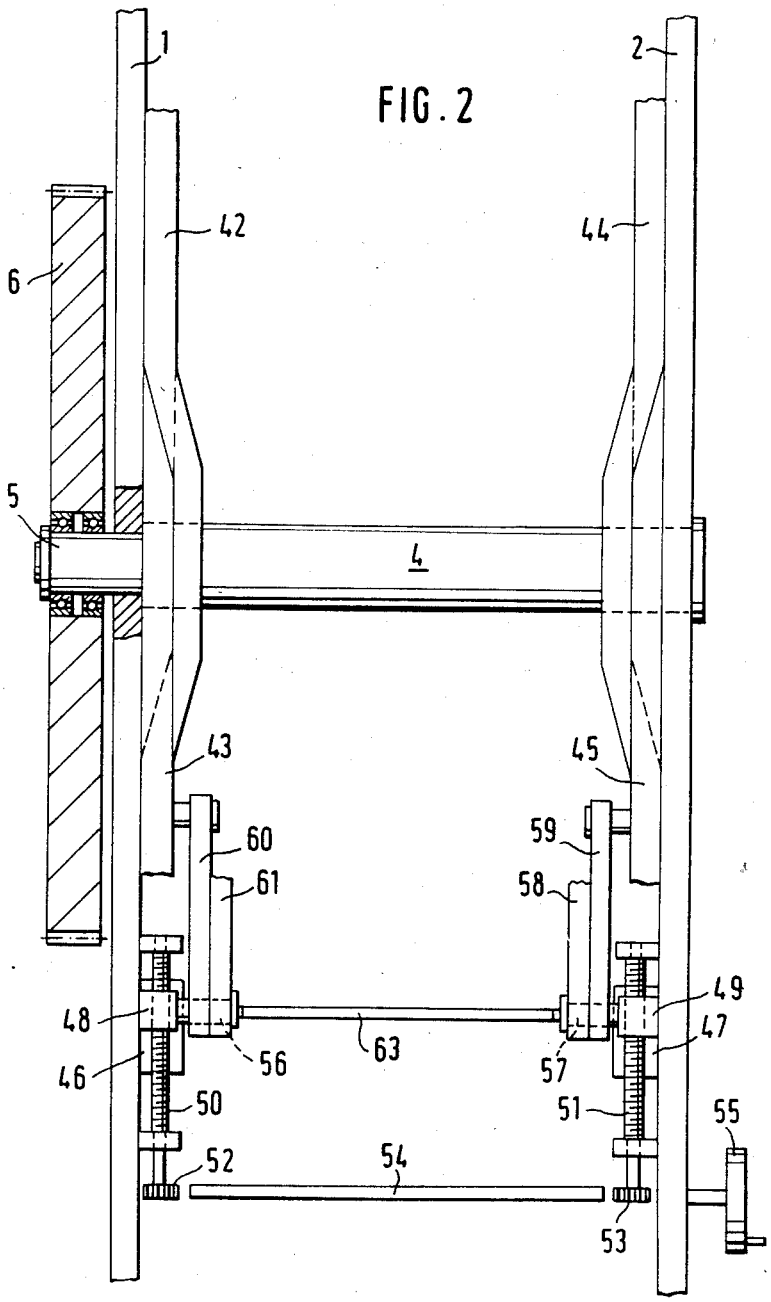
FIG. 2 is a fragmentary side elevation of the adjusting means of the intersecting arms carrying the backing cylinders or impression cylinders.

As shown in FIGS. 1 and 2, guides 46 and 47 connected to the frames 1 and 2 serve to guide nuts 48 and 49. The latter are adjustable in height by way of spindles 50 and 51. For this purpose, the lower end of the spindles 50 and 51 have sprockets 52 and 53 which form part of angular gearing. Both of the unillustrated angular gearings are interconnected by a connecting shaft 54 so that, by turning the hand wheel 55, both nuts 48 and 49 can be raised or lowered to the same extent. The nuts 48 and 49 comprise pins 56 and 57 each carrying two or steering members lugs 58 and 59 or 60 and 61, respectively. The free end of the lug 59 is pivoted to the straight lever 45, the free end of lug 58 to the cranked lever 44, the free end of lug 51 to the straight lever 43 and the free end of lug 61 to the cranked lever 42. By turning the hand wheel 55, the levers 44 and 45 or 42 and 43 can therefore be adjusted relatively to each other by the same amount. This adjustment enables the impression cylinders 27, 29, 30 and 32 to be brought to the correct position corresponding to the inserted plate cylinder. The impression and supporting cylinders are not shown in FIG. 2 but it is indicated in FIG. 1 that for example the impression cylinder 29 as well as the supporting cylinder 35 are mounted by one end at one end of the lever 44. At the other end, the impression cylinder 29 as well as the supporting cylinder 35 are rotatably mounted at one end of the lever 42 (FIG. 2). FIG. 2 also shows that the two pins 56 and 57 are interconnected by way of a rod 63 for stabilising purposes.

Drying fans 64 are provided between the individual printing mechanisms consisting of plate cylinder, impression cylinder and supporting cylinder.

I claim:

1. A printing press, which comprises a plurality of inking mechanisms having inking cylinders, and a plurality of plate cylinders and backing cylinders mounted on support shafts and driven by a common central gear, the plate cylinders, inking mechanisms and inking cylinders being mounted on carriages which are mounted for movement toward and away from the associated backing cylinders along respective guides, said guides being located at spaced positions around the central gear, said guides extending from approximately tangentially to radially of the central gear, gears of the backing cylinders have pitch circles located relative to the central gear such that the pitch circles will, when projected axially, make contact with a pitch circle of the central gear, and wherein, at contact point zones of the press, gears of the plate cylinders engage the central gear as well as the gears of the backing cylinders, a plurality of two armed levers pivotally mounted at their centers on the central shaft of said central gear to intersect in pairs, support shafts of the respective backing cylinders being mounted at the ends of said two-armed levers, and means for simultaneously pivoting pairs of the two-armed levers by equal amounts in opposite directions.

2. A printing press according to claim 1, wherein, in the case of an intaglio printing press, impression cylinders and supporting cylinders are mounted at the ends of the levers which intersect in pairs.

3. A printing press according to claim 1, wherein inner levers of the levers intersecting in pairs have crank portions at central regions thereof such that the inner levers engage over outer levers of the levers intersecting in pairs, and the outer ends of the levers substantially lie in parallel radial planes.

4. A printing press according to claim 1, wherein the means for pivoting the pairs of intersecting levers comprises two pivotably interconnected steering members of equal length for each pair of levers, the steering members being pivoted to respective ones of the pair of intersecting levers at equal spacings from their pivotal axis, and wherein a pivot means for supporting the steering members is adjustably mounted for movement on a diametral line of the central gear in fixed guides.

5. A printing press according to claim 4, wherein the pivot means is adjustable by a spindle drive.

* * * * *